US007727093B2

(12) United States Patent
Lamson et al.

(10) Patent No.: US 7,727,093 B2
(45) Date of Patent: Jun. 1, 2010

(54) LACROSSE HEAD HAVING A BALL STOP PORTION WITH LOWERED BOTTOM SURFACE

(75) Inventors: Kyle Larry Lamson, Chelmsford, MA (US); Alexander Reynolds, Wayland, MA (US)

(73) Assignee: Warrior Sports, Inc., Warren, MI (US)

( * ) Notice: Subject to any disclaimer, the term of this patent is extended or adjusted under 35 U.S.C. 154(b) by 411 days.

(21) Appl. No.: 11/740,445

(22) Filed: Apr. 26, 2007

(65) Prior Publication Data

US 2008/0268988 A1 Oct. 30, 2008

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| D265,845 | S | 8/1982 | Brine, Jr. et al. | |
| 5,035,434 | A | 7/1991 | Taylor et al. | |
| 5,037,112 | A | 8/1991 | Brine, III et al. | |
| 5,054,790 | A | 10/1991 | Brine, III et al. | |
| 5,067,726 | A | 11/1991 | Brine, III et al. | |
| 5,568,925 | A | 10/1996 | Morrow et al. | |
| 5,651,549 | A | 7/1997 | Dill et al. | |
| 5,935,026 | A | 8/1999 | Dill et al. | |
| RE38,216 | E * | 8/2003 | Morrow et al. | 473/513 |
| 7,104,904 | B1 * | 9/2006 | Gait | 473/513 |
| 2002/0173388 | A1 * | 11/2002 | Morrow et al. | 473/513 |
| 2006/0040771 | A1 * | 2/2006 | Filice et al. | 473/513 |
| 2007/0178995 | A1 * | 8/2007 | Schmidt et al. | 473/513 |

* cited by examiner

*Primary Examiner*—Gene Kim
*Assistant Examiner*—Mike Chambers
(74) *Attorney, Agent, or Firm*—Warner Norcross & Judd LLP

(57) ABSTRACT

A lacrosse stick including a lacrosse head attached to a handle, wherein the lacrosse head has a taller, or thicker, ball stop, wherein a portion of the ball stop portion is lowered with respect to the immediately adjacent portions of the sidewall portions relative to a centerline of the handle. The net securing structures in the ball stop are preferably located in the lowered portion and therein provides increased ball retention characteristics. The lower portion of the ball stop portion includes a concave inner surface that is preferably flared, or sloped, slightly outwardly along its interior surface from its front side to its back side. The openings for attaching the netting in the ball stop are preferably slightly recessed with respect to the upper surface.

11 Claims, 3 Drawing Sheets

LACROSSE HEAD HAVING A BALL STOP PORTION WITH LOWERED BOTTOM SURFACE

TECHNICAL FIELD

The present invention relates generally to a lacrosse head and, more particularly, to a lacrosse head for use by women, which includes a ball stop portion with a lowered bottom surface.

BACKGROUND OF THE INVENTION

Current women's lacrosse heads are typically constructed of an open frame having a bail stop portion with a concave interior surface that defines a bail stop, a pair of sidewall portions that generally extend from the ball stop portion, and a lip or scoop portion that interconnects the sidewall portions remotely of the ball stop portion. Openings or other attachment structures are carried by the frame for securing a lacrosse netting around the backside of the frame, leaving the opposing front side of the frame open for receiving lacrosse balls. A throat or other structure generally exteriorly projects from the ball stop portion of the frame and is intended to engage or secure a handle to the head.

The ball stop area of a lacrosse head, in conjunction with the netting attached thereto, provides the user with an area to hold and cradle the lacrosse ball during play. The ball retention characteristics of the ball stop area are thus dictated by such factors as the height of the ball stop, the location of the openings, or stringing holes, in the ball stop for attaching the netting, any flaring in the ball stop portion, and the relative tautness or looseness of the netting attached to the stringing holes.

It is highly desirable to provide a lacrosse head having increased ball retention characteristics in the ball stop portion. Moreover, it is highly desirable to provide a lacrosse head having decreased netting wear in the bail stop area. It is further desirable to provide a lacrosse head with these characteristics that is intended for use by women.

SUMMARY OF THE INVENTION

Accordingly, it is an advantage of the present invention is to provide a lacrosse head having improved ball retention characteristics.

It is another advantage of the present invention to provide a lacrosse head having improved net wear characteristics in the ball stop area.

It is still another advantage of the present invention to provide a lacrosse head having these advantages that is intended for use by women.

The present invention provides a lacrosse head having a taller, or thicker, ball stop portion, wherein a portion of the ball stop portion is lowered with respect to the adjacent sidewall portions. This allows the stringing holes to be lowered as welt. The present invention thus provides increased ball retention characteristics as compared to traditional lacrosse heads having standard sized ball stop portions.

The present invention also provides a ball stop portion in which the lower portion of the concave inner surface may also be flared slightly outwardly along its interior surface from its front side to its back side. The openings for attaching the netting are therefore slightly recessed with respect to the upper surface. This provides for increased ball retention and further aids in preventing premature wearing of the netting in the ball stop region.

These and other features and advantages of the present invention will become apparent from the following description of the invention, when viewed in accordance with the accompanying drawings and appended claims.

DETAILED DESCRIPTION OF THE PREFERRED EMBODIMENT

The present invention is directed at a lacrosse head having improved ball retention characteristics. More particularly, the present invention is directed to a lacrosse head for use by women. It will be understood, however, that the lacrosse head can be utilized in a variety of different purposes.

Figure 1:
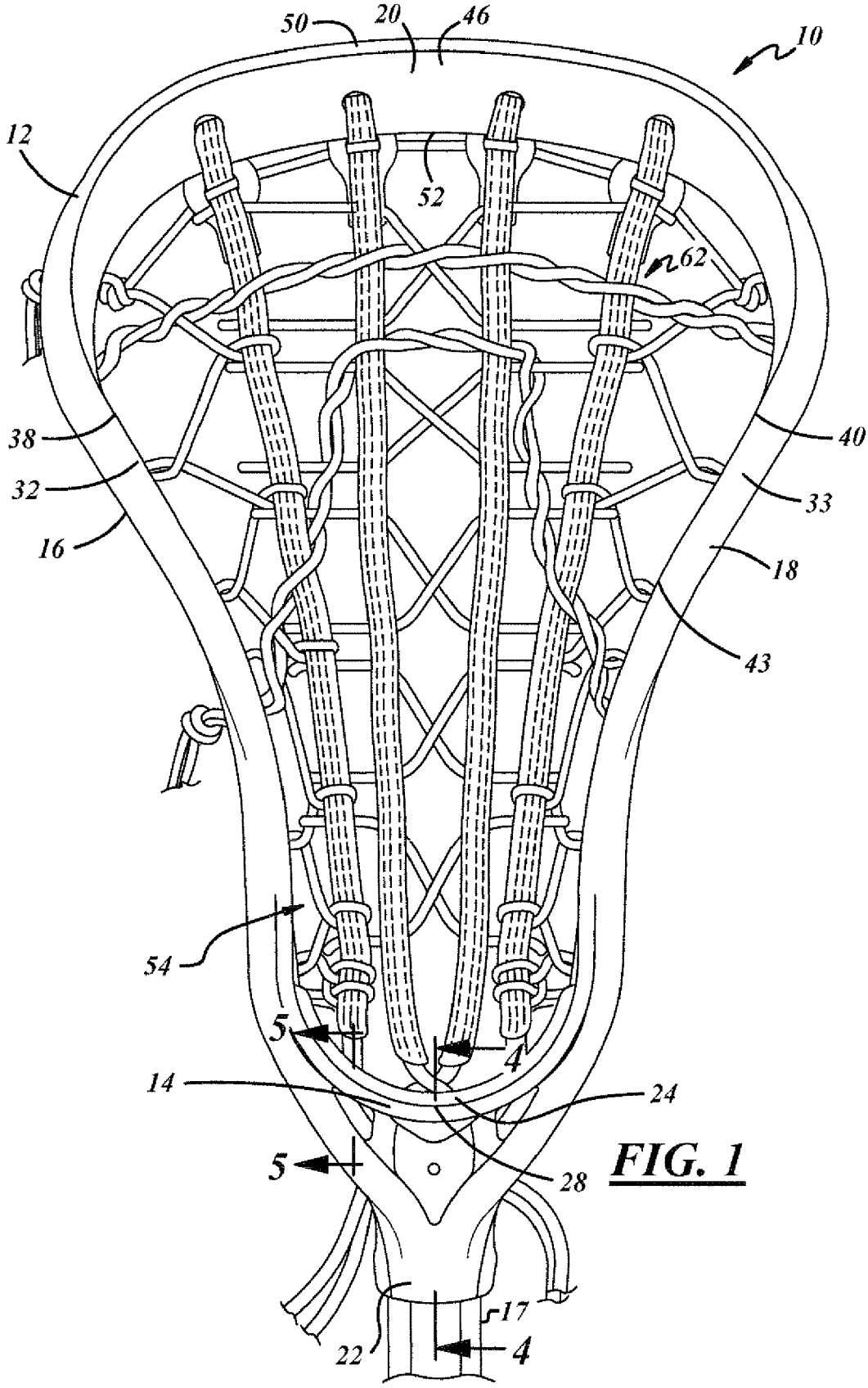
FIG. 1 is a front view of a lacrosse head having a ball stop portion with a lowered bottom surface in accordance with one embodiment of the present invention.

Referring first to FIG. 1, the lacrosse head 10 has a frame element 12, which includes a ball stop portion 14, a pair of opposing sidewall portions 16, 18, and a scoop portion or lip portion 20 connecting the pair of opposing sidewall portions 16, 18 opposite the ball stop portion 14. The lacrosse head 10 has a throat portion 22 that extends generally rearwardly from the frame element 12 and ball stop portion 14 for attachment of a lacrosse handle or element 17 therein. The lacrosse handle 17 is preferably secured in the throat portion 22 by a securing means, such as a screw or the like, which is inserted into a fixation hole (not shown) formed in the throat portion 22. However, it will be understood that the lacrosse handle 17 can be secured to the lacrosse head in a variety of other suitable ways.

Figures 2, 3:
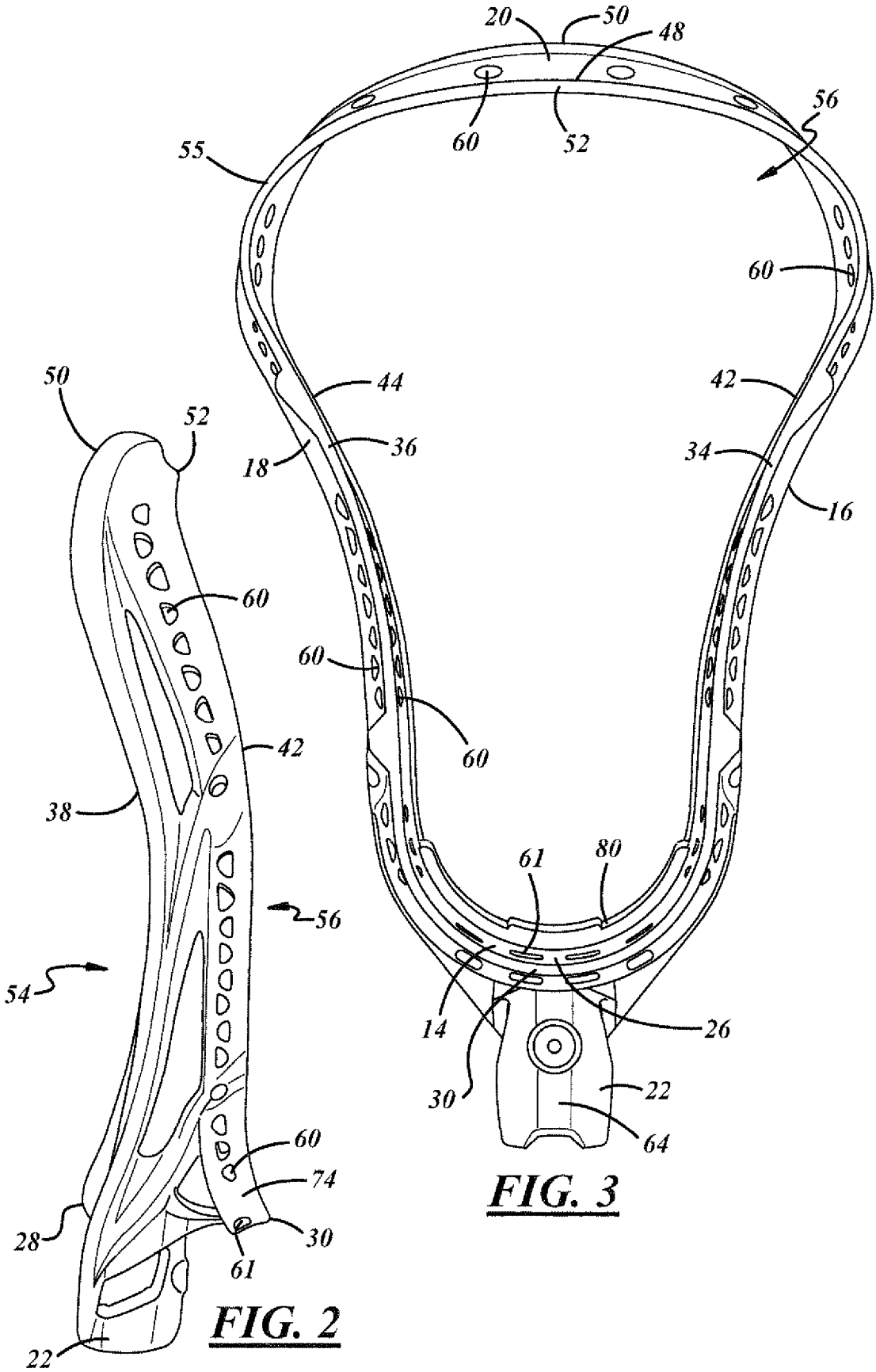
FIG. 2 is a side view of the lacrosse head of FIG. 1.
FIG. 3 is a back view of the lacrosse head of FIG. 1.
Figure 4:
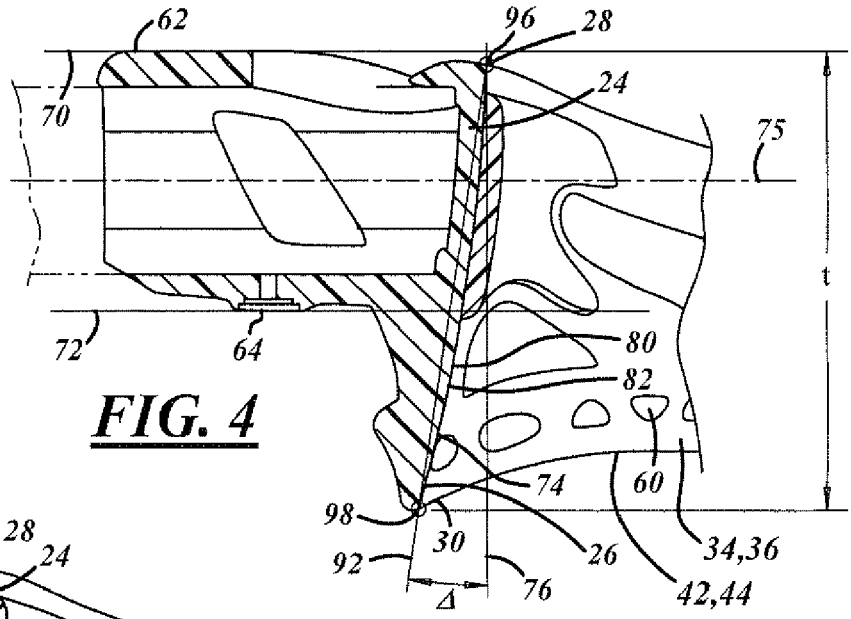
FIG. 4 is a section view of a portion of the lacrosse head of FIG. 1 taken along line 4-4 wherein the concave inner surface of the ball stop portion is sloped at an angle Δ of 7 degrees relative to a vertical reference plane.

As best shown in FIGS. 2 and 4, the ball stop portion 14 has an upper portion 24 and a lower portion 26. The upper portion 24 has an upper surface 28 and the lower portion 26 has a lower surface 30. Additionally, each sidewall portion 16, 18 has an upper portion 32, 33 and a lower portion 34, 36. Each sidewall portion 16, 18 also has a respective upper surface 38, 40 and lower surface 42, 44. The scoop portion 20, similarly, has an upper portion 46 and lower portion 48. The upper portion 46 has an upper surface 50 and the lower portion 48 has a lower surface 52. Collectively, the upper surfaces 28, 38, 50, and 40 define a ball receiving area 54, while the lower surfaces 30, 42, 52 and 44 define a ball retaining area 56.

The transition between the respective lower portions 26, 34, 48 and 36 along its respective lower surfaces 30, 42, 52 and 44 is preferably relatively smooth, as is the transition between the respective upper portions 24, 32, 46, and 33 along its respective upper surfaces 28, 38, 50, and 40. However, it is conceivable that the transitions along the respective lower surfaces 30, 42, 52 and 44 and/or upper surfaces 28, 38, 50, and 40 could be more abrupt or irregular (i.e. not smooth) and still fall within the spirit of the invention.

The lower portions 26, 34, 48 and 36 define a back side 55 of the frame element 12 and preferably have a plurality of net securing structures 60 contained therein. The net securing structures 60 are preferably stringing holes that are formed through the lower portions 26, 34, 48 and 36 to allow attachment of the lacrosse netting 62. The attachment of the netting 62 on the back side 38 of the frame element 12 allows the front side 43 of the frame, corresponding to the upper portions 24, 32, 48, and 36 to be open to allow a lacrosse ball 97 to enter or exit there between. While the net securing structures 60 are preferably string holes, a variety of other suitable attachment structures may be utilized. For the purposes of the present invention, the net securing structures in the ball stop portion 14 are hereinafter denoted by reference numeral 61.

As best shown in FIG. 4, a first horizontal reference plane 70 is defined as a tangent plane to the upper surface 62 of the throat portion 22. The first horizontal reference plane 70 is parallel to a second horizontal reference plane 72 that is defined as a tangent plane to the lower surface 64 of the throat portion 22. It will be understood that these horizontal reference planes 70, 72 are merely reference planes and not structural elements of the lacrosse head 10. Moreover, the first horizontal reference plane 70 is parallel to a horizontal reference plane corresponding to the centerline 75, or to the upper surface, of a lacrosse handle 17 inserted within the throat portion 22.

The lower portion 26 of the ball stop portion 14 is located lower than the immediately adjacent lower portion 34, 36 of each of the sidewall portions 16, 18 and preferably also lower than the entirety of the lower portions 34, 36. The lower portion 26 is also preferably located lower with respect to the lower portion 48 of the scoop portion 20 as determined with respect to the horizontal reference plane 70. In other words, the lower surface 30 of the lower portion 26 lies further beneath the horizontal reference plane 70 than the respective immediately adjacent lower surface 42, 44 of each of the sidewall portions 16, 18 and also preferably lies further beneath than the entire lower surface 42, 44, and the lower surface 52 of the scoop portion 20. The portion of the lower portion 26 lying below the respective immediately adjacent lower surface 42, 44 with respect to the horizontal reference plane horizontal reference planes 70, 72 is hereinafter referred to as the tail drop 74.

In addition, the net securing structures 61 in the tail drop 74 may also be lowered relative to the net securing structures 60 in the sidewalls 16, 18. This allows the adjoined netting 62 to be lowered as well (i.e. the netting does not need to curve upward to secure to the net securing structures in the ball stop 14). This allows the lacrosse ball to be retained further downward with respect to the horizontal reference plane 70 and centerline 75 (i.e. increases the ball retention in the ball stop region) while contacting the inner surface 80. Further, this may reduce wear and tear of the netting 62 in the area of the net securing structures 61 that would contact the lacrosse ball regularly as the lacrosse ball is retained against the ball stop 14.

In addition to being located lower than the immediately adjacent lower portion 34, 36 of the sidewall portions 16, 18, the thickness (t) of the ball stop portion 14 is also thicker than any portion of the sidewall portions 16, 18 or lip 20. This thickness (t) is measured relative to a vertical reference plane 76 that is perpendicular to the horizontal reference plane 70 and extending between the upper surface 28 and the lower surface 30. Again, as will be understood, this vertical reference plane 76 is only a reference plane and is not a structural element of the lacrosse head 10.

The increased thickness (t) of the ball stop portion 14, in combination with the tail drop 74 having the lowered net securing structures 61, provides increased ball retention than traditional women's lacrosse heads. The invention is primarily intended for women's lacrosse heads, as a similar ball stop thickness (t) contemplated in the present invention is not currently allowed in men's lacrosse heads due to current lacrosse regulations regarding a maximum ball stop thickness of two inches, as will be readily understood by one of ordinary skill in the art.

Conversely, the 2007 U.S. Lacrosse Women's Lacrosse Rules do not require a similar two-inch maximum overall thickness as required by men's lacrosse regulations, but requires a maximum ball stop height for plastic/molded lacrosse heads, as defined in Appendix E, Sections 12 and 13, between 3.2 centimeters minimum and 6.55 centimeters maximum (between about 1.26 and 2.58 inches), with the inside curved plastic wall not deviating by more than 7 degrees from perpendicular along the long axis of the handle. The 2007 U.S. Lacrosse Women's Lacrosse Rules also define the maximum allowable height at the beginning of the sidewall (measured 3.4 centimeters (about 1.34 inches) from the midpoint 90 of the ball stop portion 14) of between 2.8 centimeters and 4.7 centimeters (between about 1.10 and 1.85 inches), wherein thereafter the height of the sidewall portions 16, 18 may taper thereafter towards the scoop portion 20. The present invention is preferably configured to meet all of the 2007 U.S. Lacrosse Women's Rules. Moreover, as one of ordinary skill recognizes, the overall relative thickness of the regions of the ball stop portion 14, the sidewall portions 16, 18, and the scoop portion 20 may vary outside of these ranges, as one of ordinary skill recognizes, and still fall within the claims of the present invention so as to satisfy further modifications of the U.S. Lacrosse Women's Lacrosse Rules or any other organizational rules that may be in effect currently or proposed and enacted in the future.

Figure 5:
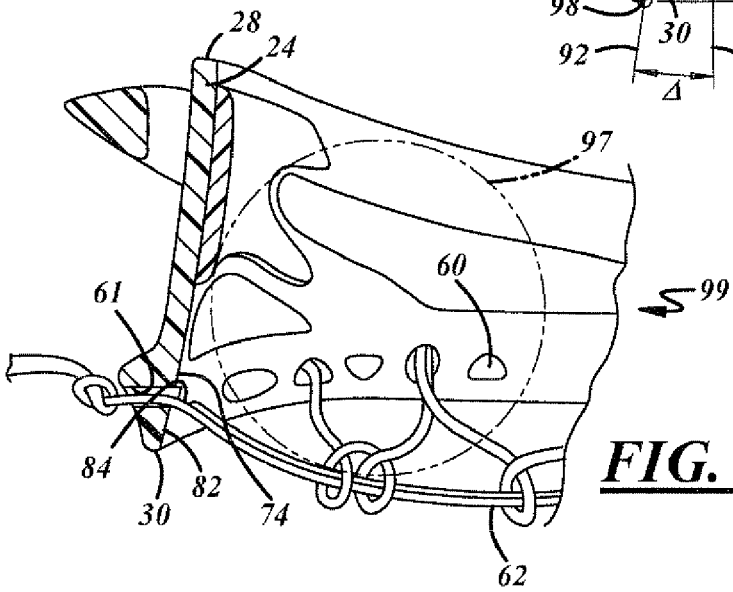
FIG. 5 is a section view of a portion of the lacrosse head of FIG. 2 taken along line 5-5.
Figure 6:
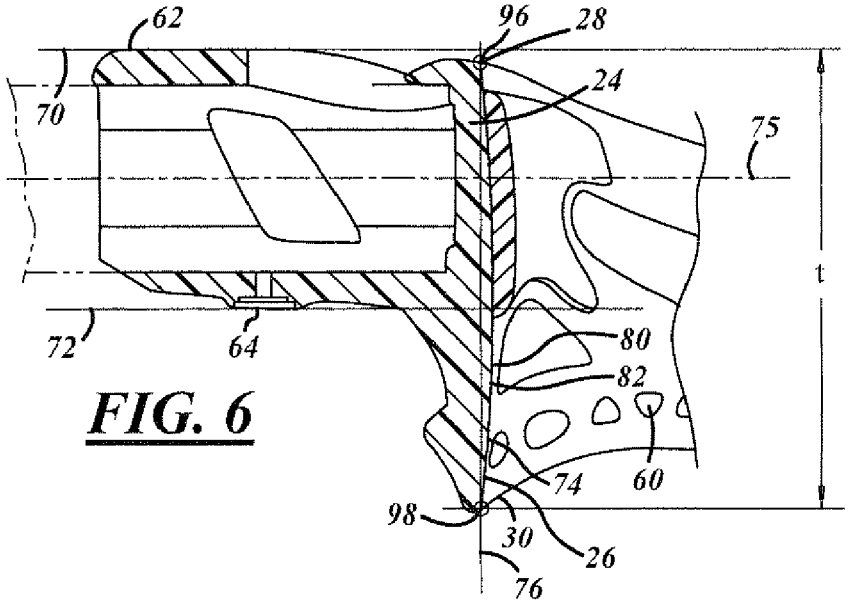
FIG. 6 is an alternative view of FIG. 4 wherein the concave inner surface of the ball stop portion is sloped at an angle Δ of 0 degrees relative to a vertical reference plane.

In one embodiment, the ball stop portion 14 also includes a concave inner surface 80. The shape of the concave inner surface 80 is designed to hold a lacrosse ball therein 97 and may take on many shapes as one of ordinary skill recognizes. In the preferred embodiment as shown in FIGS. 4 and 5, the concave inner surface preferably slopes gradually outwardly (away from the scoop portion 20) in the direction from the upper surface 28 to the lower surface 30. This creates a lower slightly recessed portion 82 of the concave inner surface 80 within the tail drop 74 in which the net securing structures 60 are located. The slope of the concave inner surface 80 is measured as the angle Δ between a line 92 extending from a point 96 on the upper surface 28 to a point 98 on the lower surface 30 and a vertical line 94 beginning at point 96 on the upper surface that is planar to the vertical reference plane 76. Preferably, in order to comply with current the 2007 NCAA Women's Lacrosse Rules, angle Δ is between about 0 and 7 degrees. Of course, in other preferred embodiments such as shown in FIG. 6, that tail drop 74 can be formed wherein the concave inner surface does not slope inwardly (i.e. angle Δ is 0 degrees).

As one of ordinary skill appreciates, as shown in FIGS. 4 and 5, this slightly recessed portion 82 slightly increases the ball retention area 99 as compared with traditional women's heads without the slightly recessed portion. Further, as best shown in FIG. 5, the portions 84 of the netting 62 attached or in very close proximity to the net securing regions 60 in the tail drop 74 are therefore slightly recessed relative to the upper portion 24. Thus, a lacrosse ball 97 will not typically contact the portion 84 of the netting 62 corresponding to the net securing regions 60, which is believed to decrease wear and tear on the netting 62 associated with the frame element 12, which is typically the area of most wear on a netting 62.

The addition of the tail drop 74 to a women's lacrosse head can be accomplished using traditional molding techniques well known to those of ordinary skill in the molding arts. The smooth transition along the relative surfaces from the ball stop area 14 to the sidewall portions 16, 18 to the scoop portion 20 also the frame element 12 to be molded easily.

Thus, the present invention provides a lacrosse head having a tail drop 74 that provides a player with increased ball retention capabilities and improved netting wear and tear resistance.

While the preferred embodiments of the present invention illustrate a preferred shape for the tail drop 74 and the corresponding ball stop portion 14, it should be recognized by those of ordinary skill that the shape of the tail drop 74 and ball stop portion 14 is not limited to the embodiments displayed herein, but may take on a variety of other shapes and still fall within the spirit of the present invention, with the proviso that at least a portion of the tail drop 74 lies further beneath the horizontal reference planes 70, 72 than the lowest portions of the sidewall portions 16, 18 and scoop portion 20 as described above. For example, the shape of the tail drop 74 may be altered by changing the slope on the lower surface 30 of the ball stop portion 14 extending away from the lower surfaces 42, 44 of the sidewall portions 16, 18 to be a more abrupt or less abrupt slope. Moreover, the lower surface 30 of the ball stop portion 14 may take on a jagged or smooth transition along its length towards the throat portion 22 from the lower surfaces 42, 44 of the sidewall portions 16, 18. Further, the outer shape of the ball stop portion 14 opposite the concave inner surface 80 may be shaped so as not to correspond to the concave inner surface 80 (i.e. it could be squared off, for example) along its entire length.

Having now fully described the invention, it will be apparent to one of ordinary skill in the art that many changes and modifications can be made thereto without departing from the spirit or scope of the invention as set forth herein.

What is claimed is:

1. A lacrosse stick frame element comprising:

a scoop portion having an upper portion and a lower portion, said upper portion including an upper surface and said lower portion including a lower surface;

a pair of opposing sidewall portions coupled to said scoop portion, each of said pair of sidewall portions having an upper portion and a lower portion, said upper portion including an upper surface and said lower portion including a lower surface;

a ball stop portion coupled to each of said pair of opposing sidewall portions and having an upper portion and a lower portion and a concave inner surface, said ball stop portion including a tail drop, said upper portion including an upper surface and said lower portion including a lower surface, said concave inner surface forming a curved concave surface between said opposing sidewall portions, said concave inner surface also curved outwardly toward the scoop between the ball stop lower surface and the ball stop upper surface for increased retention of a lacrosse ball in said ball stop portion;

a throat region coupled to said ball stop portion and extending rearwardly away from said scoop portion, said throat region including an upper surface that is tangential to a first horizontal reference plane, said throat region including a lower surface that is tangential to a second horizontal reference plane, said first horizontal reference plane parallel to said second horizontal reference plane;

a vertical reference plane extending perpendicular to said first horizontal reference plane and said second horizontal reference plane; and a net joined with the pair of opposing sidewall portions and the ball stop portion;

wherein said lower surface of said lower portion of said ball stop portion corresponding to said tail drop is lowered with respect to said first horizontal reference plane and said second horizontal reference plane and wherein said tail drop is lowered with respect to said lower surface of each of said pair of sidewall portions, wherein said tail drop includes a plurality of tail drop net securing structures, wherein said pair of opposing sidewalls include a plurality of sidewall net securing structures, wherein all of the tail drop net securing structures are lower than all of the plurality of sidewall securing structures, wherein at least one of the plurality of tail drop net securing structures is recessed rearwardly with respect to the upper surface of the ball stop so that the at least one of the plurality of tail drop net securing structures is displaced rearwardly relative to the vertical surface plane while at least a portion of the upper surface is disposed in the vertical reference plane, wherein the net is joined with the plurality of tail drop net securing structures and with the plurality of sidewall net securing structures in a configuration so that a lacrosse ball disposed in the net is prevented from contacting and abrading a net portion immediately adjacent the plurality of tail drop net securing structures, and so that the lacrosse ball engages the net and at least a portion of the concave inner surface of the ball stop when the ball is located adjacent the ball stop, and wherein the plurality of tail drop net securing structures are lowered sufficiently below the plurality of sidewall net securing structures so that the net portion immediately adjacent the plurality of tail drop net securing structures is void of an abrupt curve, whereby the lacrosse ball adjacent the ball stop is further prevented from abrading the net adjacent the plurality of tail drop structures.

2. The lacrosse stick frame element of claim 1, wherein said concave inner surface includes a slightly recessed portion corresponding to said tail drop, wherein the tail drop includes a tail drop lowermost surface, wherein the tail drop lowermost surface is lowered with respect to a lowermost surface of each of said sidewall portions.

3. The lacrosse stick frame element of claim 2, wherein said slightly recessed portion is sloped outwardly away from the scoop portion at an angle Δ relative to a line within said vertical reference plane and a line extending between a point on said upper surface of said ball stop portion and a point on said lower surface of said ball stop, wherein said angle Δ is between about 0 and 7 degrees.

4. The lacrosse stick frame of claim 1 wherein the lower surface corresponding to the tail drop transitions smoothly and upwardly to the lower surfaces of each the sidewalls.

5. The lacrosse stick frame of claim 1 wherein the lower surface corresponding to the tail drop transitions along an abrupt slope upwardly to the lower surfaces of each of the sidewall portions.

6. A lacrosse stick frame element comprising:

a scoop portion having an upper portion and a lower portion, said upper portion including an upper surface and said lower portion including a lower surface;

a pair of opposing sidewall portions coupled to said scoop portion, each of said pair of opposing sidewall portions having an upper portion and a lower portion, said upper portion including an upper surface and said lower portion including a lower surface;

a ball stop portion coupled to each of said pair of opposing sidewall portions and having an upper portion and a lower portion, said ball stop portion having a tail drop, said upper portion including an upper surface and said lower portion including a lower surface; and a throat region coupled to said ball stop portion and extending rearwardly away from said scoop portion, said throat region including a upper surface that is tangential to a first horizontal plane, said throat region including a lower surface that is tangential to a second horizontal reference plane, said first horizontal reference plane parallel to said second horizontal reference plane, wherein said lower surface of said lower portion of said ball stop portion corresponding to said tail drop is lowered with respect to said first horizontal reference plane and said second horizontal reference plane and wherein at least a portion of said lower surface of said tail drop is lowered with respect to said lower surface of each of said pair of opposing sidewall portions, wherein said ball stop portion includes a concave inner surface having a recessed portion corresponding to said tail drop, said recessed portion being sloped outwardly away from the scoop portion at an angle Δ defined between a line within a vertical reference plane and a line extending between a point of said upper surface of said ball stop portion and a point on said lower surface of said ball stop, wherein said angle Δ is between about 0 and 7 degrees, wherein said concave inner surface, including said recessed portion, curves toward said vertical reference plane and said scoop portion between the ball stop lower portion and the ball stop upper portion, wherein the tail drop and sidewalls include a plurality of net securing structures, wherein all the net securing structures in the tail drop are lower than all the net securing structures in the sidewalls relative to the first horizontal reference plane, wherein the net securing structures in the tail drop are lowered relative to the net securing structures in the sidewalls so that a net joined with the net securing structures in the tail drop is void of any abrupt curves engagable by a lacrosse ball in the net, wherein said concave inner surface restricts the lacrosse ball from contacting said net securing structures in the tail drop, and whereby the tail drop improves confinement of the lacrosse ball during play and inhibits abrasion of the net secured to said net securing structures in the tail drop.

7. The lacrosse stick frame element of claim 6, wherein said one or more net securing structures comprise one or more stringing holes.

8. The lacrosse stick frame of claim 6 wherein the lower surface corresponding to the tail drop transitions smoothly and upwardly to the lower surfaces of each the sidewall portions.

9. The lacrosse stick frame of claim 6 wherein the lower surface corresponding to the tail drop transitions along an abrupt slope upwardly to the lower surfaces of each of the sidewall portions.

10. A lacrosse stick comprising:

a handle;

a frame element comprising:

a scoop portion having an upper portion and a lower portion, said upper portion including an upper surface and said lower portion including a lower surface;

a pair of opposing sidewall portions coupled to said scoop portion, each of said pair of sidewall portions having an upper portion and a lower portion, said upper portion including an upper surface and said lower portion including a lower surface;

a ball stop portion coupled to each of said pair of opposing sidewall portions and having an upper portion and a lower portion and a concave inner surface, said ball stop portion having a tail drop, said upper portion including an upper surface and said lower portion including a lower surface, said concave inner surface extending toward said scoop portion between the upper surface and the lower surface, said concave inner surface also forming a curved concave surface between said opposing sidewall portions, for increased retention of a lacrosse ball in said ball stop;

a throat region coupled to said ball stop portion and extending rearwardly away from said scoop portion, said throat region including a upper surface that is tangential to a first horizontal reference plane, said throat region including a lower surface that is tangential to a second horizontal reference plane, said first horizontal reference plane parallel to said second horizontal reference plane, said first horizontal reference plane and said second horizontal reference plane also being parallel to a centerline defined by said handle;

a plurality of net securing structures located in said scoop portion, said pair of opposing sidewall portions and said ball stop, wherein said lower surface of said lower portion of said ball stop portion corresponding to said tail drop is lowered with respect to said first horizontal reference plane and second horizontal reference plane and wherein said tail drop is lowered with respect to said lower surface of each of said pair of opposing sidewall portions; and a netting coupled to said plurality of net securing structures, wherein all of the net securing structures in the ball stop are lower than all of the net securing structures in both the sidewall portions and the scoop portion, relative to the first horizontal plane, wherein the net securing structures in the ball stop are recessed away from the scoop with respect to the upper surface of the ball stop so that said lacrosse ball is inhibited from engaging a portion of the netting immediately adjacent said net securing structures in the ball stop when said lacrosse ball is positioned in the ball stop and wherein said concave inner surface includes a slightly recessed portion corresponding to said tail drop, wherein said slightly recessed portion includes one or more of said plurality of net securing structures and wherein said slightly recessed portion is sloped outwardly away from the scoop portion at an angle Δ relative to a line within a vertical reference plane and a line extending between a point of said upper surface of said ball stop portion and a point on said lower surface of said ball stop, wherein said angle Δ is between about 0 and 7 degrees and wherein at least one of said plurality of net securing structures is located within said tail drop, said at least one of said plurality of net securing structures located within said tail drop being located lower relative to said centerline of said handle than each of said plurality of net securing structures located in said pair of opposing sidewall portions.

11. The lacrosse stick of claim 10 wherein the lower surface of the ball stop portion transitions smoothly along a less abrupt slope upwardly toward the lower surfaces of the pair of sidewalls.

* * * * *